United States Patent [19]

Robinson et al.

[11] Patent Number: 5,027,618

[45] Date of Patent: Jul. 2, 1991

[54] KNITTED FABRIC

[75] Inventors: Frank Robinson; Gerald F. Day, both of Derbyshire, United Kingdom

[73] Assignee: General Motors Corporation, Detroit, Mich.

[21] Appl. No.: 559,972

[22] Filed: Jul. 26, 1990

Related U.S. Application Data

[63] Continuation of Ser. No. 412,140, Sep. 25, 1989, abandoned.

[30] Foreign Application Priority Data

Sep. 27, 1988 [GB] United Kingdom ..... 8822637

[51] Int. Cl.[5] ..... D04B 1/10

[52] U.S. Cl. ..... 66/202; 66/195

[58] Field of Search ..... 66/191, 194, 195, 196, 66/197, 198, 200, 202

[56] References Cited

U.S. PATENT DOCUMENTS

| | | | |
|---|---|---|---|
| 3,602,014 | 8/1971 | McDonald, Jr. et al. | 66/202 |
| 4,236,286 | 12/1980 | Abler et al. | 66/191 |
| 4,307,587 | 12/1981 | Baesgen et al. | 66/195 |
| 4,784,886 | 11/1988 | Monget et al. | 66/202 |
| 4,794,767 | 1/1989 | Lombardi | 66/202 |
| 4,909,049 | 3/1990 | Baesgen et al. | 66/195 |

FOREIGN PATENT DOCUMENTS

| | | |
|---|---|---|
| 1057208 | 2/1967 | United Kingdom . |
| 2024880 | 1/1980 | United Kingdom . |
| 2024881 | 1/1980 | United Kingdom . |
| 2127444 | 4/1984 | United Kingdom . |

*Primary Examiner*—Werner H. Schroeder
*Assistant Examiner*—John J. Calvert
*Attorney, Agent, or Firm*—Davis, Hoxie, Faithfull & Hapgood

[57] ABSTRACT

A weft knitted double jersey fabric is knitted with a textured continuous filament synthetic yarn on a knitting machine having a gauge of 10 to 14 to give, in the relaxed state of the fabric, from 4 to 6 wales per cm and from 10.5 to 22 courses per cm. The yarn used preferably has a count of 550 to 850 decitex, especially 680 to 750 decitex and may be an air textured polyester yarn. The fabrics produced are dense, heavyweight fabrics with a weight of at least 380 gms/square meter. They have superior abrasion and snag resistance and are suitable for use as upholstery fabrics particularly for vehicle seat covers.

10 Claims, 1 Drawing Sheet

KNITTED FABRIC

This is a continuation of co-pending application Ser. No. 07/412,140 filed on Sept. 25, 1989, now abandoned.

BACKGROUND OF THE INVENTION

This invention relates to a knitted fabric suitable for use as an upholstery fabric, for example for covering seats in vehicles, particularly automobiles.

Hitherto, woven fabrics and some warp knitted fabrics have been used for covering automobile seats. Weft knitted fabrics, however, have not been used for this purpose because their known properties particularly their susceptibility to abrasion and snagging suggest that they will not be suitable.

SUMMARY OF THE INVENTION

According to the invention, a weft knitted fabric comprising a textured, continuous filament synthetic yarn knitted in a mainly double jersey construction on a weft knitting machine having a gauge in the range 10 to 14 is characterised by the fabric having, in the relaxed state of the fabric, from 4 to 6 wales per cm and from 10.5 to 22 courses per cm.

The textured, continuous filament synthetic yarn used for knitting the fabric of the invention preferably has a count in the unrelaxed state in the range 550 to 850 decitex, more preferably in the range 680 to 750 decitex. A particular preferred yarn is an air-textured continuous filament polyester yarn.

The machine used to knit the weft-knitted fabric of the invention is preferably a flat V-bed knitting machine of gauge in the range 10 to 14. Gauge is an expression of the number of needles per inch along the bed of the knitting machine so that 10 to 14 gauge machines have needle bed densities in the range 3.94 to 5.51 needles per cm. A preferred machine is a 12 gauge machine.

It will be appreciated that in a fabric in accordance with the invention the ratio of courses/cm to wales/cm can lie in the range from 10.5/6 to 22/4, i.e., from 1.75:1 to 5.5:1. In preferred fabrics in accordance with the invention, this ratio is at least 2:1. By way of contrast, in conventional weft knitted double jersey fabrics used in the knitwear trade this ratio is usually in the range of from 1:1 to 1.4:1.

The uniquely tight, packed structure used to made the weft knitted, double jersey fabric of the invention changes its properties as compared with knitwear fabric so as to make it seem quite unlike the known double jersey fabrics. The fabrics produced are dense, heavyweight fabrics, typically with a fabric weight of at least 380 gms/square mater and with some fabrics in the range above a weight of 500 gms/square meter. Most importantly, the fabrics have an abrasion resistance and a snag resistance which is remarkably improved, sufficiently to make them suitable as upholstery fabrics, even for such demanding end uses as vehicle seat base and seat back covers.

BRIEF DESCRIPTION OF THE DRAWING

The invention is illustrated by the accompanying drawing in which.

DESCRIPTION OF PREFERRED EMBODIMENTS

Figure 1:
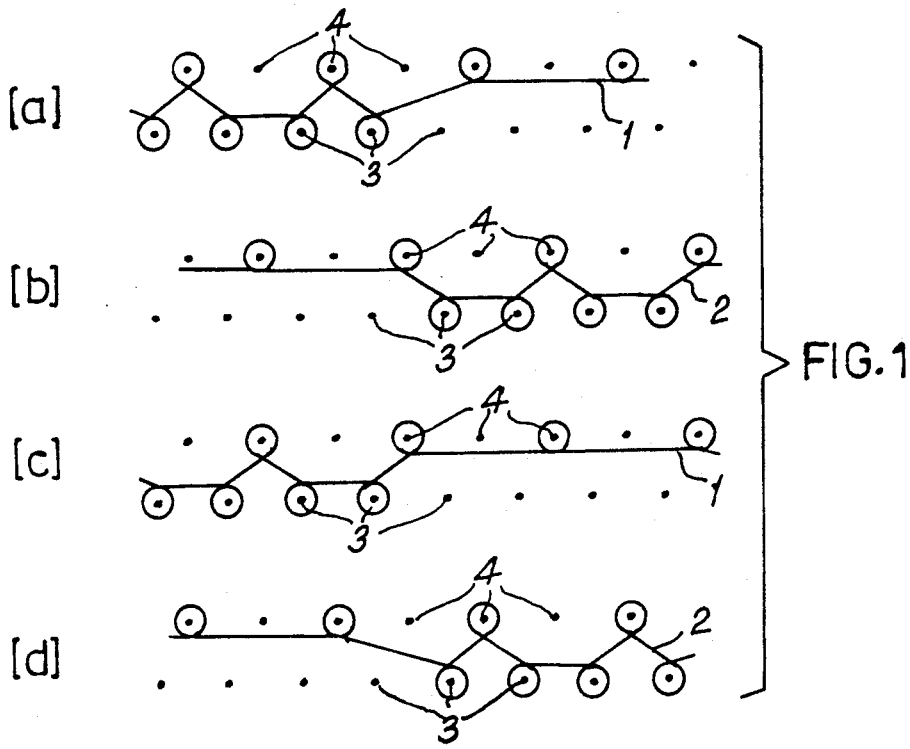
FIGS. 1(*a*) to 1(*d*) show diagrammatically four successive courses of a Jacquard double jersey fabric construction with a bird's eye backing knitted on needles of opposed beds of a flat V-bed knitting machine, and FIGS. 2(*a*) to 2(*d*) show diagrammatically four successive courses of a Jacquard striped double jersey fabric also knitted on a flat V-bed machine.

Referring to FIGS. 1(*a*) to 1(*d*), all courses are knitted with an air textured, continuous filament polyester yarn of 715 decitex but the yarn 1 used for courses 1(*a*) and 1(*c*) is coloured differently from the yarn 2 used to knit courses 1(*b*) and 1(*d*). In each course, the yarn 1 or the yarn 2, as the case may be, is looped around the needles 3 of the front bed of the knitting machine and around the needles 4 of the rear bed of the knitting machine in the loop configurations shown.

Figure 2:
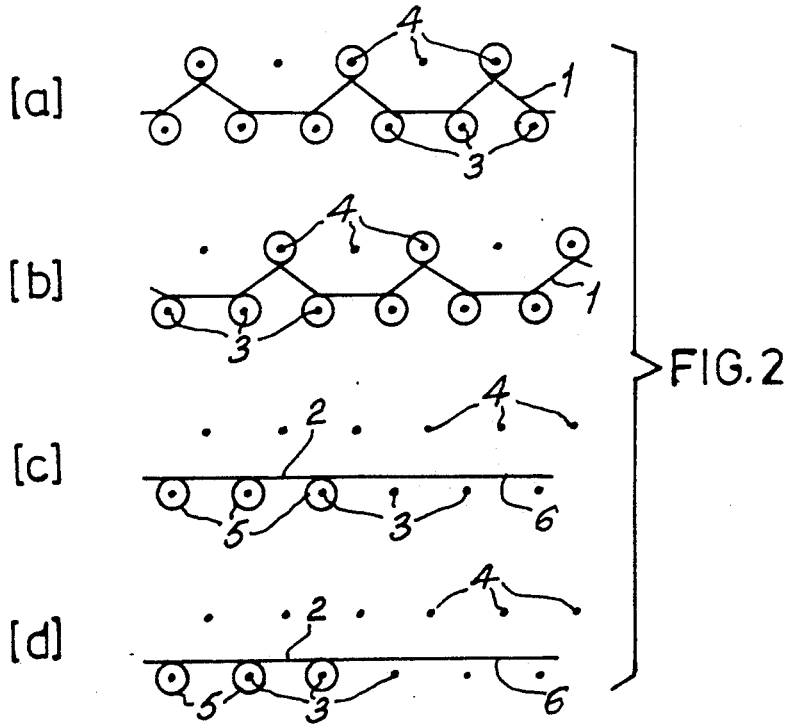

Referring to FIGS. 2(*a*) to 2(*d*), the same two yarns 1 and 2 are used as in FIGS. 1(*a*) to 1(*d*) but in this case yarn 1 is knitted in courses 2(*a*) and 2(*b*) and yarn 2 is courses 2(*c*) and 2(*d*). Yarn 1 is looped around the needles 3 and 4 of the front and rear needles beds in the loop configuration shown. Yarn 2 on the other hand is only knitted on the needles 3 of the front needle bed in a repeat of three successive needle loops 5 interspersed with floats 6 across three needle spaces. In the final fabric these floats 6 are located on the inside of the fabric so that they are not susceptible to snagging or abranding action on the face of the fabric.

Fabrics were knitted in the constructions illustrated in the drawing at various course densities using the yarns 1 and 2 specified. Examples of these fabrics are specified in the following Table 1 in which Examples 1, 2 and 3 are knitted in the construction illustrated by and described in relation to FIGS. 1(*a*) to 1(*d*) of the drawing and Examples 4 and 5 are knitted in the construction illustrated by and described in relation to FIGS. 2(*a*) to 2(*d*) of the drawing.

TABLE 1

| Example No. | *Wales/cm | *Courses/cm | Length of yarn in cms to produce 100 stitches per course: Yarn 1 | Yarn 2 | Weight in g/m² of the fabric |
|---|---|---|---|---|---|
| 1 | 5.5 | 10.5 | 53.6 | 54.8 | 469 |
| 2 | 5.5 | 12.0 | 51.7 | 52.3 | 515 |
| 3 | 5.5 | 13.5 | 48.5 | 49.0 | 543 |
| 4 | 5.5 | 18 | 52.7 | 66.1 | 380 |
| 5 | 5.5 | 22 | 51.1 | 63.3 | 430 |

*Measured over a 5 cm length of the fabric after steam relaxation.

After relaxation the yarn had an effective count of 750 decitex.

The fabrics of Examples 1 to 5 were tested as regards their resistance to snagging using the Mace Snag Test described in British Standards Handbook 11:1974. In this test, a tube of the fabric is positioned over a rubber-covered cylindrical drum 203 mm long and 83 mm in diameter and carrying a tubular woven wool felt of 3.2 mm thickness.

The drum, with its axis horizontal, is made to rotate at 60 r.p.m. A phosphor bronze sphere (the mace) 31.75 mm in diameter and carrying 11 equi-spaced tungsten-carbide points each projecting 9.5 mm is suspended above the drum by a chain with points of the mace resting on the fabric sample. In each test the drum is rotated for a period of 10 minutes, during which it performs a total of 600 revolutions. Two samples are normally run, with the fabric courses parallel to the axis of rotation of the drum in the first sample, tending to produce snagging in the wale direction, and at right angles to this direction in the second sample, tending to produce snagging in the course direction. The action of the mace is to tend to pull yarns or groups of filaments out of the fabric to form distorted loops on the surface. The performance of the fabric in relation to the density of snags produced is assessed by mounting the tested samples individually in a viewing cabinet and comparing them with a set of nine photographic standards, ranging from Standard 5 (no snagging) to Standard 1 (severe snagging), in half standard steps. A result between two adjacent photographic standards is given the more severe rating.

Samples of each of the fabrics of Examples 1 to 5 were subjected to the test procedure just described and each sample registered Standard 4, showing that each of the fabrics had a resistance to snagging which is at least as good as that of a conventional woven fabric used for covering automobile seats.

The abrasion characteristics of the fabrics of Examples 1 to 5 were tested by the Taber Abrasion Test described in ASTM D 3884 in which samples of each fabric were subjected to 1,000 cycles on the Taber Abrader using CS-10 wheels and 1,000 g weights. In each case the fabrics of Examples 1 to 5 showed no obvious defects at the end of the tests, indicating that each fabric had a sufficiently high abrasion resistance for employment in an automobile seat cover.

Finally, each of the fabrics of Examples 1 to 5 was subjected to stretch testing on a Fryma extensiometer on fabric samples cut to a size of 90 mm by 75 mm, the longer dimension corresponding to the direction of measurement of the stretch (wale or course). The tests were carried out in accordance with the conditions prescribed in British Standard Specification No. 4294:1968 with the jaw separation of the extensiometer set at 75 mm. One end of the sample under test was clamped in the fixed jaw, a "Perspex" (Trade Mark) plate was placed on top of the sample to ensure it was flat and the other end of the sample was then clamped in the movable jaw. The "Perspex" plate was removed and the sample was then loaded and measured as specified in British Standards Specification No. 4294:1968. The measurements were carried out at 20 degrees C. and 65.0 relative humidity. In these stretch tests the fabrics of Examples 1 to 5 gave the following results:

TABLE 2

| Example No. | Direction | Stretch % | % age extension after: 1 minute | 30 minutes |
|---|---|---|---|---|
| 1 | Wale | 27.5 | 3.1 | 3.1 |
| | Course | 29.3 | 4.0 | 4.0 |
| 2 | Wale | 23.5 | 2.2 | 2.2 |
| | Course | 16.0 | 0 | 0 |
| 3 | Wale | 24.9 | 3.6 | 3.6 |
| | Course | 10.7 | 0 | 0 |
| 4 | Wale | 7.8 | 0 | 0 |
| | Course | 9.6 | 0 | 0 |
| 5 | Wale | 7.8 | 0 | 0 |
| | Course | 7.8 | 0 | 0 |

What is claimed is:

1. A weft knitted fabric comprising a textured, continuous filament synthetic yarn knitted in a mainly double jersey construction on a weft knitting machine having a gauge in the range 10 to 14, characterised in that the fabric has, in the relaxed state of the fabric, from 4 to 6 wales per cm and from 10.5 to 22 courses per cm.

2. A weft knitted fabric according to claim 1, characterised in that the ratio of courses/cm to wales/cm is in the range 1.75:1 to 5.5:1.

3. A weft knitted fabric according to claim 2, characterised in that the ratio of courses/cm to wales/cm is at least 2:1.

4. A weft knitted fabric as claimed in claim 1, characterised in that the yarn comprising the fabric has a count in the unrelaxed state of from 550 to 850 decitex.

5. A weft knitted fabric as claimed in claim 4, characterised in that the yarn comprising the fabric has a count in the unrelaxed state of from 680 to 750 decitex.

6. A weft knitted fabric as claimed in claim 1, characterised in that the fabric has a weight of at least 380 gms/square meter.

7. A weft knitted fabric according to claim 1, characterised in that the yarn comprising the fabric is an air textured, polyester yarn.

8. A weft knitted fabric according to claim 1, characterised in that it is knitted in a Jacquard construction with a bird's eye backing.

9. A weft knitted fabric according to claim 1, characterised by being knitted on a 12 gauge flat V-bed knitting machine.

10. An upholstery fabric piece characterised by comprising a weft knitted fabric as claimed in claim 1.

* * * * *